US008302684B2

(12) United States Patent
Eken

(10) Patent No.: US 8,302,684 B2
(45) Date of Patent: Nov. 6, 2012

(54) CONTROLLING THE FLOW OF A MULTIPHASE FLUID FROM A WELL

(75) Inventor: Adriaan Nicolaas Eken, GS Rijswijk (NL)

(73) Assignee: Shell Oil Company, Houston, TX (US)

( * ) Notice: Subject to any disclaimer, the term of this patent is extended or adjusted under 35 U.S.C. 154(b) by 642 days.

(21) Appl. No.: 11/793,556

(22) PCT Filed: Dec. 20, 2005

(86) PCT No.: PCT/EP2005/056971

§ 371 (c)(1),
(2), (4) Date: Oct. 1, 2007

(87) PCT Pub. No.: WO2006/067151

PCT Pub. Date: Jun. 29, 2006

(65) Prior Publication Data

US 2008/0041586 A1 Feb. 21, 2008

(30) Foreign Application Priority Data

Dec. 21, 2004 (EP) ..... 04106806

(51) Int. Cl.
*E21B 43/12* (2006.01)
*E21B 34/06* (2006.01)

(52) U.S. Cl. ..... 166/250.01; 166/373; 166/91.1; 166/53

(58) Field of Classification Search ..... 166/250.15, 166/53, 91.1, 373
See application file for complete search history.

(56) References Cited

U.S. PATENT DOCUMENTS 6,283,207 B1 * 9/2001 Lemetayer ..... 166/250.15
(Continued)

FOREIGN PATENT DOCUMENTS

EP 0840836 11/2000
(Continued)

OTHER PUBLICATIONS

SPE paper No. 49463 "Real-Time Artificial Life Optimization" by W.J G.J. der Kinderen, C.L Dunham and H.N.J.

*Primary Examiner* — Jennifer H Gay

(57) ABSTRACT

A method for controlling the flow of a multiphase fluid from a well extending into a subsurface formation, which well is provided at a downstream position with a valve having a variable aperture, which method comprises allowing the multiphase fluid to flow at a selected aperture of the valve; selecting a flow parameter of the multiphase fluid, which flow parameter is responsive to changes in a gas/liquid ratio of the multiphase fluid at an upstream position in the well, and a setpoint for the flow parameter; and monitoring the flow parameter; controlling the flow parameter towards its setpoint by manipulating the aperture of the valve; wherein the control time between detection of a deviation from the setpoint and the manipulation of the aperture is shorter than the time needed for the multiphase fluid to travel 25% of the distance between the upstream and downstream positions. Further a well extending into a subsurface formation for producing a multiphase fluid to surface, which well is provided at a downstream position with a valve having a variable aperture, and with a control system for controlling the multiphase flow.

20 Claims, 3 Drawing Sheets

U.S. PATENT DOCUMENTS

| | | | | |
|---|---|---|---|---|
| 6,293,341 | B1 | 9/2001 | Lemetayer | 166/250.15 |
| 6,454,002 | B1 | 9/2002 | Stokes et al. | 166/250.15 |
| 6,575,244 | B2 * | 6/2003 | Chang et al. | 166/250.15 |
| 6,595,294 | B1 | 7/2003 | Dalsmo et al. | 166/369 |
| 6,988,554 | B2 * | 1/2006 | Bodine et al. | 166/363 |
| 6,991,034 | B2 * | 1/2006 | Wilde | 166/250.15 |
| 7,278,481 | B2 * | 10/2007 | Eken | 166/250.15 |
| 2004/0216884 | A1 * | 11/2004 | Bodine et al. | 166/335 |
| 2004/0244989 | A1 | 12/2004 | Eken | 166/369 |
| 2008/0041586 | A1 * | 2/2008 | Eken | 166/250.15 |

FOREIGN PATENT DOCUMENTS

| | | |
|---|---|---|
| WO | WO9704212 | 2/1997 |

* cited by examiner

CONTROLLING THE FLOW OF A MULTIPHASE FLUID FROM A WELL

The present application claims priority from European Patent Application No. 04106806.5 filed 21 Dec. 2004.

FIELD OF THE INVENTION

The present invention relates to a method for controlling the flow of a multiphase fluid from a well extending into a subsurface formation.

BACKGROUND OF THE INVENTION

Multiphase flow of liquid such as oil and/or water, and gas, is almost always involved in the production of hydrocarbons from subsurface formations. Upward multiphase fluid flow in a well can often lead to flow stability problems.

Production instabilities can be encountered for example in the form of large fluctuations of the oil production rate, e.g. more than 25% of the average production rate, or in situations where big slugs of oil are alternated by gas surges. Particular problems are encountered in gas-lifted wells, in which gas is injected from surface via a casing/tubing annulus and an injection valve upstream in the well into the production tubing. Also here, severe instabilities of the gas/liquid ratio of the fluid produced up the tubing can occur. A special problem is observed in dual gas-lifted wells, wherein two tubings are arranged, usually with inlets for reservoir fluid at different depths. A common problem there is that production through one of the tubings ceases, due to instabilities in the lift gas injection into the tubings.

Such instability phenomena are often referred to as "heading", e.g. tubing heading, casing heading etc. Heading is generally undesirable, not only because of production loss, but also because downstream fluid handling equipment such as separators and compressors can be upset, damaging of the wellbore or flowline, and negative influences on other wells connected the same equipment.

Several systems and methods have been proposed in the past to control heading phenomena.

International patent application with publication No. Wo 97/04212 discloses a system for controlling production from a gas-lifted oil well, comprising a choke for adjusting the flow of crude oil from a production tubing of the well, into which lift gas is injected at a downhole position in the well. A control system is provided to dynamically control the opening of the choke, such that the casing head pressure in the lift gas injection line is minimized and stabilized.

SPE paper No. 49463 "Real-Time Artificial Lift Optimization" by W. J. G. J. der Kinderen, C. L. Dunham and H. N. J. Poulisse discloses a combination of this system with a production estimator based on a measurement of pressure drop over a fixed restriction. The pressure drop is used to estimate production, and the choke is slowly stepwise adjusted to find an optimum opening for maximum production.

USA patent publication No. U.S. Pat. No. 6,293,341 discloses a method for controlling a liquid and gaseous hydrocarbons production well activated by injecting gas, wherein a produced-hydrocarbon flow rate is estimated from the temperature measurement of the produced hydrocarbons, and is compared with four predetermined flow rate thresholds. Depending on the outcome of the comparison, and depending on the gas-injection rate and the aperture of the outlet choke, the gas injection flow rate or the aperture of the outlet choke are stepwise adjusted by a predetermined amount.

It is an object of the present invention to provide a method for controlling the flow of a multiphase fluid from a well that provides efficient and robust control in a variety of situations and with minimum requirements for control hardware.

SUMMARY OF THE INVENTION

To this end there is provided a method for controlling the flow of a multiphase fluid from a well extending into a subsurface formation, which well is provided at a downstream position with a valve having a variable aperture, which method comprises the steps of allowing the multiphase fluid to flow at a selected aperture of the valve;

selecting a flow parameter of the multiphase fluid, which flow parameter is responsive to changes in a gas/liquid ratio of the multiphase fluid at an upstream position in the well, and a setpoint for the flow parameter; and monitoring the flow parameter;

controlling the flow parameter towards its setpoint by manipulating the aperture of the valve;

wherein the control time between detection of a deviation from the setpoint and the manipulation of the aperture is shorter than the time needed for the multiphase fluid to travel 25% of the distance between the upstream and downstream positions.

BRIEF DESCRIPTION OF THE DRAWINGS

An embodiment of the invention will now be described in more detail and with reference to the accompanying drawings, wherein.

DETAILED DESCRIPTION OF THE INVENTION

Figure 1:
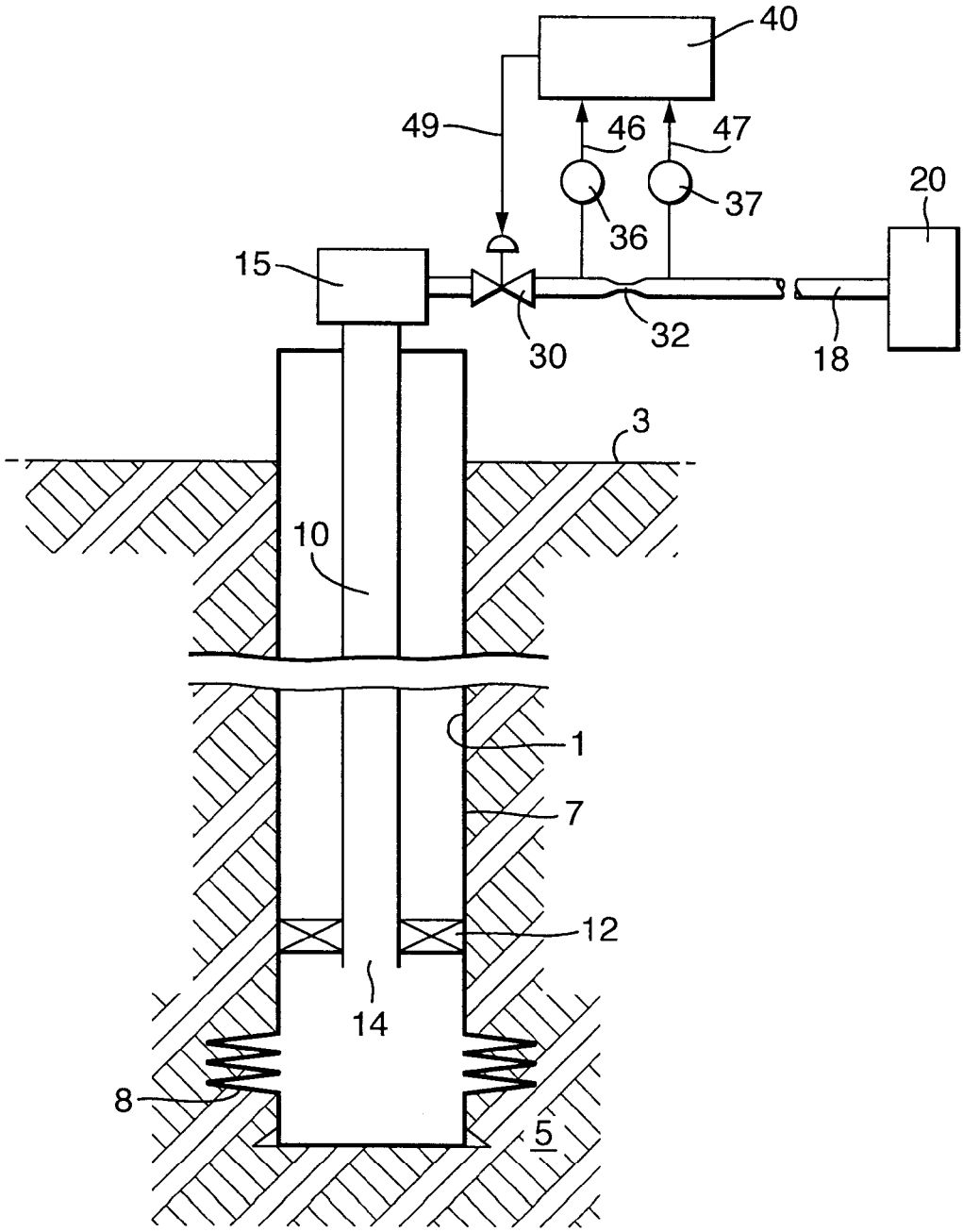
FIG. 1 shows schematically a free-flowing well embodying a first application of the present invention.

Applicant has realized that an efficient control of the multiphase fluid flow can be achieved by sufficiently quickly manipulating the variable production valve in response to a change in the gas/liquid ratio of the produced fluid at an upstream position in the well. Such a change can be derived from a flow parameter characterizing the combined gas and liquid flow of the multiphase fluid in the production tubing. Examples of the flow parameter are the volumetric flow rate, the mass flow rate, but other definitions of a flow parameter can be used as well, as will be pointed out hereinbelow.

If for example the flow parameter indicates that at the lower end of the production tubing a liquid slug is formed, the production valve should be quickly opened so that the liquid is transported away immediately, before the slug can grow due to a growing hydrostatic pressure in the tubing. If the flow parameter on the other hand indicates a large influx of gas into the production tubing, the valve should be closed sufficiently to create a corrective backpressure.

The time scale on which the valve should be manipulated can be related to the time it takes for the fluid to flow up the production tubing, from the upstream position where the change in the gas/liquid ratio occurs to the downstream position of the variable valve. Applicant has found that for a sufficiently fast response the valve should be manipulated faster than the time needed for the multiphase fluid to travel 25% of the distance between the upstream and downstream positions. Preferably the control time is shorter than 15%, more preferably shorter than 10% of the time needed for the multiphase fluid to pass the distance between the upstream and downstream positions, for example between 5 and 10% of this time. In fact, very good control is achieved if the response time is minimized, so that the flow parameter is continuously measured, and every fluctuation or change is immediately translated into an updated optimum setpoint for the valve aperture, and the valve is instantaneously manipulated accordingly. In typical wells the control time will be one minute or less, preferably 30 seconds or less, most preferably 10 seconds or less, and for example 1 second.

Preferably the flow parameter is measured near the downstream position of the variable valve. Such a position is closer to the variable valve than to the upstream position at which the gas/liquid ratio changes, for example within a maximum of 10% of the distance between upstream and downstream positions from the downstream position. A flow parameter detected at surface is influenced by a changing gas/liquid ratio upstream in the well, e.g. at the lower end of the production tubing, with the speed of sound, i.e. almost instantaneously. The required control time for the valve, on the other hand, is related to the flow velocity of the multiphase fluid, which is slower. So detecting a change in flow parameter leaves sufficient time for counteraction. Most preferably the flow parameter is measured at or near the well head, at surface.

In a particularly advantageous embodiment the flow parameter is estimated as a function of a pressure difference over a flow restriction, which flow parameter does not take into account the actual composition of the multiphase fluid pertaining to the pressure difference at the flow restriction. Actual composition data for the multiphase fluid that is at a certain time at a certain location of the production tubing can in principle be obtained by a gamma-densitometer, multiphase flow meter or similar equipment. Applicant has realized that a good control can be achieved even without such actual composition data, so that the expensive equipment that would be needed to obtain that is not required.

Preferably then the variable valve itself is used as the restriction. Even though the flow parameter determined in this way may be somewhat less accurate than with a fixed restriction, this is not a problem for the task of flow control.

It will be understood that it can be advantageous to have an optimizing controller that operates on a much longer time scale and seeks to optimize or maximize the overall production by manipulating the set point of the flow parameter. The optimizing controller can for example monitor an average parameter related to production such as an average valve opening, an average pressure drop over the restriction or valve, or an average flow parameter. The time scale of such an outer loop controller is longer than the time needed for the multiphase fluid to travel the distance between the upstream and downstream positions, e.g. a timescale of many minutes, e.g. 5 minutes or more, up to one hour or even longer.

In a particular embodiment the well is a gas lifted well provided with production tubing having a gas injection valve at the upstream position. In this embodiment the main cause of disturbance for the gas/liquid ratio will be a changing gas injection rate at the gas injection valve.

In another particular embodiment the well is a dual gas lifted well wherein the production tubing forms a first production tubing, wherein further a second production tubing is arranged, and wherein a ratio of first and second flow parameters of the multiphase fluid in the first and second production tubing is controlled.

Controlling the ratio of flow in this way has been found to be an effective way of preventing that production through one of the tubings ceases whereas all gas is injected into the other, resulting overall in a very inefficient gas lift.

Thus the method of the present invention can be used to control several heading phenomena irrespective of their origin in a variety of situations.

In accordance with the invention there is also provided a well extending into a subsurface formation for producing a multiphase fluid to surface, which well is provided at a downstream position with a valve having a variable aperture, and with a control system for controlling the multiphase flow, which control system includes means for measuring a flow parameter of the multiphase fluid, which flow parameter is responsive to changes in a gas/liquid ratio of the multiphase fluid at an upstream position in the well, and a means for controlling the flow parameter towards a selected setpoint by manipulating the aperture of the valve, wherein the control system is so arranged that the control time between detection of a deviation from the setpoint and the manipulation of the aperture is shorter than the time needed for the multiphase fluid to travel 25% of the distance between the upstream and downstream positions.

Reference is made to FIG. 1. The Figure shows a free-flowing well 1 extending from surface 3 into a subsurface formation 5. The well is provided with casing 7, and at the lower end of the well perforations 8 are arranged for receiving reservoir fluid into the well. Production tubing 10 is installed, separated by a packer 12 from the casing. The production tubing extends from its upstream end 14 to a wellhead 15 at surface, and from there through a flowline 18 to downstream processing equipment 20, e.g. including a gas/liquid separator. Along the flowline a control system is arranged, comprising a controllable variable valve 30, a flow restriction 32, pressure sensors 36 and 37 upstream and downstream of the flow restriction, and a controller 40 receiving input via lines 46,47 from the pressure sensors 36,37, and having an output via line 49 for a control signal to the controllable valve 30. In a particular embodiment (not shown, but see FIG. 2), the variable valve 30 is placed at the position and plays the role of the flow restriction 32. The flow restriction 32 can also be placed upstream near the control valve 30.

The reservoir fluid received through perforations 8 into the well normally is a multiphase fluid comprising liquid and gas. The gas/liquid ratio at bottomhole conditions can depend on many factors, for example the composition of the undisturbed reservoir fluid, influx from other subsurface regions, the amount of gas dissolved in oil, and liberation of dissolved gas due to the pressure difference between the reservoir and the well. Instability in production of this multiphase fluid to surface can be observed in varying severity, also dependent on the overall production rate, tubing geometry and reservoir influx performance.

In accordance with the present invention such instabilities can be effectively controlled by manipulation of the downstream valve 30. To this end a flow parameter of the multiphase fluid is selected, which is responsive to changes in the gas/liquid ratio of the multiphase fluid at an upstream position in the well, such as at the lower end of the production tubing 10 or at the perforations.

A suitable flow parameter is the volumetric flow rate or also the mass flow rate of the multiphase fluid.

For an effective control it is not required to determine these flow rates with high accuracy. Most importantly, changes in the gas/liquid ratio are quickly detected.

The flow parameter is preferably measured at surface.

A particularly advantageous aspect of the embodiment of the invention shown in FIG. 1, is that the flow parameter is monitored by continuously monitoring the pressure difference over the flow restriction only, without monitoring another variable in order to determine an actual gas/liquid ratio pertaining to the actual pressure difference at the flow restriction. This is advantageous since it was realized that is not needed for the present invention to install equipment for measuring data pertaining to the multiphase composition, e.g. a specific small separator for control purposes, an expensive multiphase flow meter or a gamma densitometer. In the prior art such equipment is used to determine a mass balance of the multiphase fluid, e.g. a gas mass fraction, and the changes thereof as a function of time at the location of the measurement. Using such data, accurate volumetric or mass flow rates, and changes thereof as a function of time, can be derived.

It has been realized however, that a suitable flow parameter for use as controlled variable in the multiphase flow control can be derived from the pressure data alone, and that efficient control is obtained when the aperture of the variable valve is used as the manipulated variable. In this way a relatively simple, but effective, control loop is obtained that requires minimum hardware.

A suitable flow parameter FP for the flow of multiphase fluid through a variable valve forming a restriction is represented by the following relationship $$FP=f\cdot C_V\sqrt{\Delta p}, \tag{1}$$

wherein f is a (in general dimensionful) proportionality factor;

$C_V$ is a valve coefficient that characterizes the throughput at a given valve aperture v and is dependent on the aperture; and Δp is the pressure difference over the flow restriction (variable valve).

F is a generalized flow parameter.

$C_V$ has the dimension $$\frac{\text{volume}}{\text{time}\cdot\text{pressure}^{1/2}}.$$

It is common to express $C_V$ in US engineering units $$\frac{\text{US gallons}}{\text{min}\cdot psi^{1/2}},$$

following a common definition $$C_v = Q\sqrt{\frac{G}{\Delta p}}$$

wherein Q is the volumetric flow in US gallons/min, $C_V$ is the valve coefficient in US gal/min/psi$^{1/2}$, Δp is the pressure drop in psi, and G is ratio of the fluid density ρ and the water density. If we convert to the following units Q*[m$^3$/h], p*[bar], G=ρ*[kg/m$^3$]/1000[kg/m$^3$], and keep for $C_V$ the common US units, this gives:

$$Q^*=Q^*0.003785^*60$$

$$\Delta p^*=\Delta p^*0.068947$$

$$\rho^*=G^*1000\ \text{kg/m}^3.$$

Substitution in the original definition for $C_V$, and omitting the * superscript gives:

$$C_V = \frac{1}{u}\cdot Q\sqrt{\frac{\rho}{\Delta p}}, \tag{2}$$

wherein u is a conversion constant having the value 1/u=0.03656 m$^{3/2}$·kg$^{-1/2}$. In the following it will be assumed that $C_V$ and the other units discussed hereinabove have the units as given, and for that reason the constant u will appear in the equations. From equations (1) and (2) it follows that a volumetric flow rate FP=Q (units m$^3$/hr) is obtained if f is selected as $$f = f_q = u\sqrt{\frac{x}{\rho_g}+\frac{1-x}{\rho_1}}, \tag{2}$$

wherein x=the gas mass fraction of the multiphase fluid;

$\rho_g$ and $\rho_l$ are the gas and liquid densities (kg/m$^3$);

and wherein it has been assumed that $\Delta p/p_u \ll 1$, wherein $p_u$ is the pressure upstream of the restriction.

A mass flow rate FP=W (units kg/hr) is obtained if f is selected as $$f = f_W = u^2\frac{1}{f_q}. \tag{3}$$

In order to calculate either a mass or a volumetric flow rate, the gas mass fraction x of the multiphase fluid at the restriction is required. However in the method of the present invention there is not a separate measurement that can be used to this end, such as for example using a gamma densitometer. There are several suitable ways to still obtain a flow parameter that is suitable as a controlled variable.

One straightforward way is to select f=constant, independent on density. The flow parameter FP=F thus obtained has characteristics somewhere in between a mass and a volumetric flow rate. It has been found that a simple control scheme wherein this flow parameter is held at a predetermined setpoint, by manipulating the variable valve accordingly, can already provide a significant suppression of liquid slugs and gas surges.

It is also possible to estimate the mass or volumetric flow rate by estimating $f_w$ or $f_q$, without measuring a separate parameter pertaining to the actual gas/liquid ratio at the restriction. An estimate can for example be obtained by using an average gas mass fraction $x_{av}$ of the multiphase fluid that is produced. Such an average gas mass fraction can for example be obtained by analyzing the overall gas and liquid streams obtained at downstream separation equipment 20. So, in equation 2 or 3, instead of using the actual gas mass fraction of the multiphase fluid causing the pressure drop at the restriction, an average gas mass fraction $x_{av}$ is used. In order to restore some dependency on fluctuations in multiphase flow over time, deviations of the upstream pressure $p_u$ from a reference pressure $p_{ref}$ can be considered, e.g. by using $$f_q = u\sqrt{\left(\frac{x_{av}}{\rho_g}+\frac{1-x_{av}}{\rho_1}\right)-p_{ref}}\cdot\frac{1}{\sqrt{p_u}}. \tag{4}$$

Such an approximation can in particular be used when $\Delta p/p_u \ll 1$.

Estimating $f_w$ or $f_q$ can also be facilitated if there is information about the multiphase flow regime, i.e. predominantly liquid, gas or mixed gas/liquid flow.

During normal operation the flow parameter is monitored via the pressure sensors 36,37 that feed their signals into the controller 40 where the flow parameter is calculated. When the flow parameter deviates from its setpoint, the controller determines an updated setpoint for the aperture of the variable valve 30 and sends the appropriate signal through line 49 to the valve 30.

In cases that the pressure-drop across the valve is in the critical range (such as when the flow becomes sonic at the place of the restriction) the flow calculation is suitably different. In this case the flow no longer depends on the downstream pressure. The calculations remain the same with the following adjustment: instead of the differential pressure $\Delta p$ we use a fixed portion of the pressure upstream of the restriction. The transition from sub-critical to critical is dependent on the physical size and shape of the restriction, and on process conditions. Often it is found that critical conditions exist when the downstream pressure is below a transition point, which is expressed as a certain fraction of the upstream pressure, e.g. 30% or 50% or the upstream pressure. So, as the downstream pressure gets lower than the transition point, the difference between upstream pressure and the transition point is used instead of $\Delta p$. The flow parameter is thus only dependent on upstream pressure and valve opening.

According to the invention the control loop is so fast that the time between detection of a deviation from the setpoint and the manipulation of the aperture is shorter than the time needed for the multiphase fluid to travel 25% of the distance between the upstream end 14 of the production tubing 10 and the downstream valve 30.

In a typical example, the production tubing reaches from surface to a depth of 1500 m, and the overall flow velocity ignoring slippage between gas and liquid is 5 m/s. In this case the control time should be shorter than 75 s.

Very good control is achieved if the response time is minimized, so that the flow parameter is continuously measured, and every fluctuation or change is immediately translated into an updated optimum setpoint for the valve aperture, and the valve is instantaneously manipulated accordingly.

It will be understood that it is nevertheless possible to apply some filtering to remove high-frequent noise from the pressure measurements, but the filtering would typically smoothen the measurements on a time scale at maximum in the order of 5 seconds.

For starting up flow in a free-flowing well, suitably the variable production valve 30 is slowly opened until a stable flow condition is reached. It is noted that at very much reduced choke openings the heading can be stabilized because of the dominant influence that friction has in this case on the hydraulics of the system. Even though a stable flow condition can be achieved in this way, this is not a desired way to operate the well for extended periods of time since it would lead to substantial reduction of oil production.

Subsequently, the controller 40 can be switched on, followed by slowly increasing the setpoint of the controller until the setpoint for continuous operation is reached. By controlling the flow according to the present invention the production is stabilized and maximised at the same time.

Figure 2:
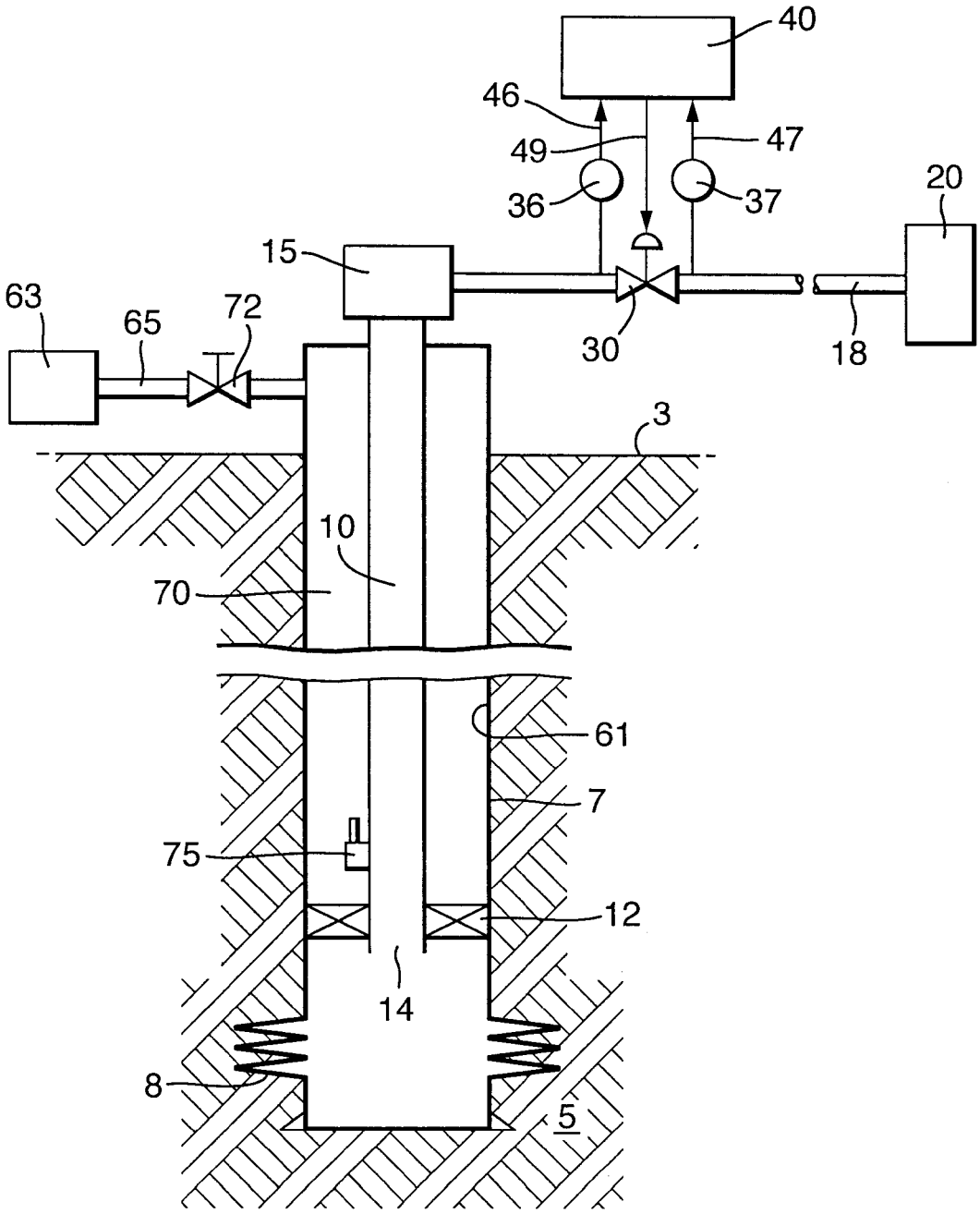
FIG. 2 shows schematically a gas-lift well embodying a second application of the present invention.

Reference is now made to FIG. 2 showing a gas lift well 61, which can also be controlled by the method of the present invention. Like reference numerals as in FIG. 1 are used for the same or similar parts.

In addition to the parts already discussed with reference to FIG. 1, the well 61 is provided with a gas-lift system comprising a source for pressurized gas 63 connected via a conduit 65 to the annulus 70 between the casing 7 and the production tubing 10. The conduit 65 is provided with an annulus valve 72. Downhole in the well 61 the production tubing 10 is provided with a gas-injection valve 75 for admitting the lift gas from the annulus 70 into the production tubing 10. Only one gas injection valve 75 is shown, but it shall be clear that more valves can be arranged at different depths.

A common problem encountered in gas-lift wells is instable production, due to "heading" phenomena. In addition to causes like the ones described for the free-flowing well hereinbefore, a particular reason for instable, in particular cyclic, production is in the interaction between the gas pressure and volume in annulus and the hydraulics in the production tubing, which is also sometimes referred to as casing heading. The annulus volume acts as a buffer for the lift gas. The casing is filled-up through the annulus valve, and depletes through the injection valve. The pressure in the annulus is determined by the influx through the annulus valve and the outflux through the gas-injection valve. The tubing hydraulics are determined by the weight of the oil/water/gas mixture and the friction losses, in combination with the driving force exerted by the reservoir.

When due to a fluctuation the bottomhole pressure decreases, the influx of reservoir fluid increases, and increases the flow rate of fluid up the production tubing. This causes a decrease of the hydrostatic pressure in the tubing, and therefore an increased influx of lift gas, which further lowers the bottomhole pressure and leads for a short while to maximum production. Since normally the capacity of pressurized gas is limited, the pressure in the annulus decreases so that gas injection is lowered or even ceases, until sufficient annulus pressure has been built up again. Then the same sequence can happen again. The occurrence and severity of such casing heading depends on many factors such as the normal differential pressure over the gas injection valve, and the relation between the annulus pressure decrease at an increased gas injection rate, and the associated bottomhole pressure decrease. It often occurs that optimal operation of a well is close-to or in the region of casing heading.

Prior art approaches to control instable gas lift wells use a controlled variable in the gas-injection part, e.g. the pressure in the annulus (casing head pressure), or the gas injection rate into the annulus. Also, the prior art uses a manipulated variable in the gas-injection part, e.g. the opening of annulus valve, so that the gas influx rate is changed in order to counteract unbalances between gas influx into and outflux from the annulus.

The present invention, on the other hand is based on a flow parameter of the multiphase fluid in the production tubing as (only) controlled variable for the fast control loop. During normal operation, after start-up, the (only) manipulated variable in the fast control loop is the aperture of valve 30.

The present invention allows a more robust suppression of casing heading, by maintaining a stable multiphase flow in the production tubing. Because the controlled variable and the manipulated variable are physically very close together, control action is more robust.

In the embodiment of FIG. 2, the manipulated variable is aperture of the production valve 30, and the operation of this valve occurs so fast in response to changes in the injection rate at the gas-injection valve 75 that the outflux rate from the annulus, i.e. the gas injection rate itself is acted upon. If the gas injection rate is at any moment detected to be too high, the valve 30 will be closed to an aperture wherein sufficient backpressure is created to lower the difference between casing and tubing pressure at the gas injection valve, so that the injection rate decreases again. If the gas injection rate appears to be too low, the aperture of the valve 30 is increased so that the hydrostatic pressure in the tubing decreases and more gas is injected.

The change in gas injection rate can be detected by flow parameters Q, W, and in particular F, as they have been have been discussed with reference to FIG. 1. As a difference with FIG. 1, there is no separate restriction in the flowline 18, but the variable valve 30 is used as restriction, over which also the pressure difference is measured. For determining a flow parameter from the pressure difference (see equation 1), the dependence of the valve coefficient from the aperture has to be taken into account. This can lead to a somewhat less accurate determination of the flow parameters, but this is acceptable for control purposes.

Normal operation of the control loop is further very similar to the one described for the free-flowing well. The control loop is so fast that the time between detection of a deviation of the flow parameter from its setpoint and the manipulation of the aperture is shorter than the time needed for the multiphase fluid to travel 25% of the distance between the position of the gas-injection valve 75 of the production tubing 10 and the downstream valve 30. Preferably the control time is as short as possible, but some filtering of noise in the pressure measurements on the time scale of seconds can be applied.

A suitable way to start up a gas-lifted well is the following. First start the well with normal lift gas flow rate and with the variable valve with opening less than optimal, to prevent casing heading. Subsequently the controller is switched on and then the setpoint for the flow parameter is increased slowly until optimal operation is obtained. Final step can be the switching on of an optimising controller.

An alternative start-up sequence is the following. First start the well with excess lift gas so that it is stable even with a nearly fully open wellhead control valve. Then switch on the controller and slowly reduce the lift gas to optimal rate. Final step can be again to switch on the optimising controller.

Figure 3:
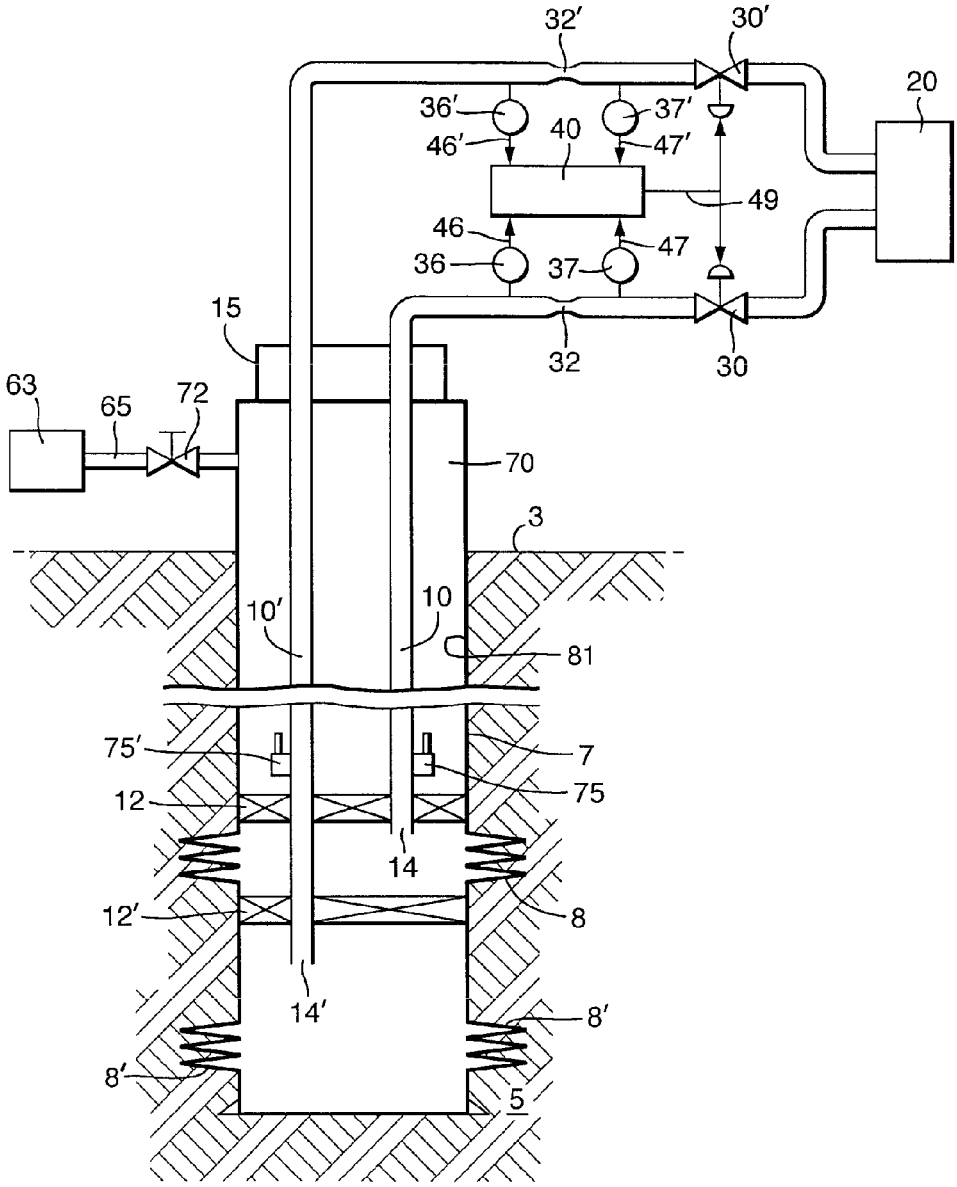
FIG. 3 shows schematically a dual gas-lifted well embodying a third application of the present invention.

Reference is now made to FIG. 3 showing a gas-lift well 81, with two production tubings 10, 10', which are arranged to receive reservoir fluid from perforations 8, 8' at their lower ends 14, 14' to which end packers 12,12' are arranged. This so-called dual gas lifted well can also be controlled by the method of the present invention. Like reference numerals as in FIGS. 1 and 2 are used for the same or similar parts, numerals of parts pertaining to the second (longer) production tubing are primed.

There is a particular problem encountered in dual gas-lifted wells. The lift gas is supplied to the gas injection valves 75, 75' through the common annulus 70. Therefore there is normally no control over the distribution of the lift gas into the two production strings 10, 10'. Of course the size of the orifices of the gas-injection valves in combination with the pressure difference across the orifices determines the distribution. However, the pressure inside the production tubes is significantly influenced by the multiphase flow in the production tubing.

Applicant has observed that upon a normal fluctuation in the hydraulic pressure of the multiphase fluid in one string the gas injected via the respective gas-injection valve into that string for example increases. This results in a higher differential pressure across that gas-injection valve, and subsequently even more gas is supplied, causing the pressure in the annulus to drop. This in turn reduces the pressure in the other production tubing. In the end one finds the first string producing slightly more than normal at double the lift gas rate, whilst the second string does not produce at all because it is deprived of any lift gas. Overall, significantly less reservoir fluid is produced, and pressurized injection gas in ineffectively used.

In the embodiment in FIG. 3 each production tubing 10, 10' is provided with a flow restriction 32, 32', over which a pressure difference is measured. The pressure data from sensors 36, 36', 37, 37' are fed to the controller 40 via lines 46, 46', 47, 47'. A flow parameter is calculated that relates to a ratio of flow rates in both tubings. In the case of using fixed restrictions 32, 32' as shown, the flow rate can be regarded as directly proportional to the square root of the pressure difference, so the ratio of pressures, or the square root thereof, can be taken as the ratio of flow rates to be controlled.

In principle one can also determine the pressure differences over the variable valves 30,30', without using separate fixed restrictions. In this case, the flow parameter can be determined from the ratio of parameters FP according to equation 1 for each tubing string, thereby taking the valve apertures into account.

In order to control the dual gas-lift well of FIG. 3, first each tubing string is operated separately to determine stable nominal lift gas injection conditions for each string alone, in particular the valve aperture and pressure drop over the restriction pertaining to the same casing head pressure for both strings, measured at the top of the annulus 70. It can be that, unless a symmetrical layout of both tubing strings was used, the lift-gas injection rate in both tubings differs, and in this case the gas injection valve can be modified. It is however not required that the gas injection is fully symmetrical in both production tubings. The total nominal lift gas requirement is the sum of the lift gas requirements for both tubings in the nominal stable conditions. From these tests a setpoint for the controller 40 that controls the ratio of flow rates in both tubing strings is determined.

After the nominal balanced lifting conditions have been determined, the dual gas lift well is started up as usual in the art, e.g. by supplying an excess of lift gas to the well, and slowly opening the production valves 30, 30'.

Now the controller 40 can be switched on. The controller 40 is arranged to manipulate via control lines(s) 49 at least one of the valves 30,30' so that the ratio of flow rates is maintained close to its setpoint. Switching on the controller is suitably done wherein care is taken that the switching on occurs smoothly and does not introduce instabilities. Then the lift gas injection rate can be slowly reduced to its normal level by sufficiently closing the annulus valve 72. Meanwhile the controlled valves are closely watched to see if one of the two tubings comes in the danger area where the choke closes too far, which can be an indication of well production problems e.g. lack of reservoir drive.

Then lift gas supply is slowly reduced and the variable valves 30 and/or 30' are manipulated so that the predetermined injection rates for both tubing strings are held in balance.

The controller can for example operate as follows. The pressure difference of one string is multiplied by predetermined factor that corresponds to the ratio of pressure differences in the balanced situation. The result in subtracted from the pressure difference determined for the other string. The controller tries to maintain the difference at zero.

The controller has to control one variable corresponding to the ratio of flow rates in both strings. In principle it can be sufficient to manipulate one of the valves 30, 30', while the other valve is kept at a constant aperture, e.g. fully open. It was found that in this case it can be preferable to control the valve of the production tubing that tends to take in more gas than desired.

In a particular embodiment, however, the controller can advantageously use the additional degree of freedom provided by the presence of the second valve to also control instabilities other than a mismatch of the ratio between gas injection rates in both strings. So, other heading phenomena can in principle be counteracted by manipulating both valves at the same time. All control action is performed so fast that the control time between occurrence of an instability (such as casing heading) or fluctuation and the manipulation of the valve(s) is shorter than 25% of the time it takes for multiphase fluid in one of the production tubings to flow up the length of that production tubing.

It will be understood that it is nevertheless possible to apply some filtering of the pressure data to remove high-frequent noise from the measurements, but the filtering would typically smoothen the measurements on a time scale not longer than 5 seconds.

The flow control according to the present invention can be the central part or inner loop of a more complex control algorithm, including one or more outer control loops as well. An outer control loop differs from the inner control loop in its characteristic control time, which is generally much slower than for the inner control loop. One particular outer control loop can aim to control an average parameter such as the average pressure drop over the restriction or the average aperture of the production valve, or the average consumption of lift gas towards a predetermined setpoint for that parameter.

Such an outer control loop can serve to maximise production of multiphase fluid through the conduit, by aiming to keep the variable production valve at the top of the production tubing in a nearly open position, so as to minimize the pressure drop in the long term and at the same time leave some control margin to counteract short-term fluctuations. An outer control loop can also aim to minimize consumption of lift gas by acting on an annulus valve.

For determining an average parameter in an outer control loop the average is suitably taken over at least 2 minutes, and in many cases longer, such as 10 minutes or more, so that that characteristic time of controlling the average parameter is relatively long as well, at least 2 minutes, but perhaps also 15 minutes or several hours.

What is claimed is:

1. A method for controlling the flow of a multiphase fluid from a well, wherein the well is connected to a subsurface formation and comprises at least one adjustable-aperture valve located at a downstream position, the method comprising:

selecting a flow parameter of the multiphase fluid, wherein the flow parameter is responsive to changes in a gas/liquid ratio of the multiphase fluid at an upstream position in the well, wherein the upstream position is near the subsurface formation;

determining a desired baseline for the flow parameter;

flowing the multiphase fluid at a selected aperture of the valve;

estimating a current flow parameter as a function of a pressure difference over a flow restriction;

comparing the estimated current flow parameter to the desired baseline of the flow parameter; and causing the estimated current flow parameter to move towards the desired baseline of the flow parameter by only adjusting the aperture of the adjustable valve, wherein the time between the comparison of the flow parameters and the adjustment of the aperture is shorter than a time needed for the multiphase fluid to travel 25% of a distance between the upstream position and the downstream position.

2. The method according to claim 1, wherein the time between the comparison of the flow parameters and the adjustment to the aperture is shorter than the time needed for the multiphase fluid to travel 15% of the distance between the upstream and downstream positions.

3. The method according to claim 1, wherein the current flow parameter is calculated based on measurements taken near the downstream position.

4. The method according to claim 1, wherein the current flow parameter is calculated by measuring a pressure difference across a flow restriction.

5. The method according to claim 4, wherein the flow restriction comprises the adjustable-aperture valve.

6. The method according to claim 1, wherein the current flow parameter is calculated based on an estimated or calculated composition of the multiphase fluid.

7. The method according to claim 1, further comprising using an optimizing controller to adjust the aperture of the valve such that the flow parameter is also optimized over a time period longer than a time needed for the multiphase fluid to travel the entire distance between the upstream position and the downstream position.

8. The method according to claim 1, wherein the well further comprises a gas-lift well provided with a production tubing, wherein the production tubing has at least one gas injection valve located near the upstream position.

9. The method according to claim 8, wherein the current flow parameter is calculated based on measurements taken near the downstream position.

10. The method according to claim 8, wherein the current flow parameter is calculated by measuring a pressure difference across a flow restriction.

11. The method according to claim 10, wherein the flow restriction comprises the adjustable-aperture valve.

12. The method according to claim 8, further comprising using an optimizing controller to adjust the aperture of the valve such that the flow parameter is also optimized over a time period longer than a time needed for the multiphase fluid to travel the entire distance between the upstream position and the downstream position.

13. The method according to claim 1, wherein the well further comprises a dual gas lift well having a first production tubing connected to a subsurface formation, and a second production tubing connected to a subsurface formation, the second production tubing being longer than the first production tubing, wherein each production tubing further comprises at least one gas injection valve located near the upstream position and at least one adjustable-aperture valve located at a downstream position.

14. The method according to claim 13, further comprising controlling a ratio between a flow parameter in the first production tubing and a flow parameter in the second production tubing to counteract a casing heading instability which occurs because both the first production tubing and the second production tubing are being produced at the same time.

15. The method according to claim 14, wherein the ratio between a flow parameter in the first production tubing and a flow parameter in the second production tubing is controlled with the adjustable-aperture valves.

16. The method according to claim 13, wherein the current flow parameter for the first production tubing is calculated based on measurements taken near the downstream position of the first production tubing and the current flow parameter for the second production tubing is calculated based on measurements taken near the downstream position of the second production tubing.

17. The method according to claim 13, wherein the current flow parameter for the first production tubing is calculated by measuring a pressure difference across a flow restriction in the first production tubing and the current flow parameter for the second production tubing is calculated by measuring a pressure difference across a flow restriction in the second production tubing.

18. The method according to claim 13, further comprising using an optimizing controller to adjust the aperture of the valve such that the flow parameter of the first production tubing and the flow parameter of the second tubing are also optimized over a time period longer than a time needed for the multiphase fluid to travel the entire distance between the upstream position and the downstream position.

19. A well connected to a subsurface formation through an upstream end of a production tubing for producing a multiphase fluid to surface, comprising:

at least one adjustable-aperture valve located at a downstream position configured to control a flow parameter of the multiphase fluid that is responsive to changes in a gas/liquid ratio of the multiphase fluid at an upstream position in the well;

a control loop only in communication with the adjustable-aperture valve, the control loop comprising pressure sensors and a controller receiving input via lines from the pressure sensors;

wherein a response time by the control loop between detection of a flow parameter deviation and manipulation of the adjustable-aperture valve is less than a time for the multiphase fluid to travel 25% of a distance between the upstream end of the production tubing and the adjustable-aperture valve.

20. The well of claim 19, wherein the controller is configured to monitor an average flow parameter over a time period longer than the control loop response time.

* * * * *